US011279895B2

(12) United States Patent
Cazaux et al.

(10) Patent No.: US 11,279,895 B2
(45) Date of Patent: Mar. 22, 2022

(54) PROCESS FOR CRYOGENIC FLUID ODORISATION

(71) Applicant: Arkema France, Colombes (FR)

(72) Inventors: Jean-Benoît Cazaux, Montestrucq (FR); Laurent Barbon, Artiguelouve (FR); Patrick Charles, Sauvagnon (FR)

(73) Assignee: Arkema France, Colombes (FR)

( * ) Notice: Subject to any disclaimer, the term of this patent is extended or adjusted under 35 U.S.C. 154(b) by 0 days.

(21) Appl. No.: 16/604,683

(22) PCT Filed: Apr. 18, 2018

(86) PCT No.: PCT/FR2018/050980

§ 371 (c)(1),
(2) Date: Oct. 11, 2019

(87) PCT Pub. No.: WO2018/197783

PCT Pub. Date: Nov. 1, 2018

(65) Prior Publication Data

US 2020/0157446 A1 May 21, 2020

(30) Foreign Application Priority Data

Apr. 25, 2017 (FR) ..... 1753565

(51) Int. Cl.
*C10L 3/00* (2006.01)

(52) U.S. Cl.
CPC ..... *C10L 3/006* (2013.01); *C10L 2290/50* (2013.01)

(58) Field of Classification Search
CPC ..... Y10S 261/17; C10L 3/006; C10J 1/00
(Continued)

(56) References Cited

U.S. PATENT DOCUMENTS 2,058,508 A 10/1936 Rolle
2,430,050 A * 11/1947 Gill ..... C10J 1/00 48/195

(Continued)

FOREIGN PATENT DOCUMENTS

DE 19837066 A1 2/2000
DE 102004050419 A1 4/2006

(Continued)

OTHER PUBLICATIONS

International Search Report and Written Opinion for International Application No. PCT/FR2018/050980, dated Jun. 22, 2018, 9 pages.

(Continued)

*Primary Examiner* — Matthew J Merkling
(74) *Attorney, Agent, or Firm* — RatnerPrestia

(57) ABSTRACT

The present invention relates to a process for odorizing a cryogenic fluid, comprising a step a) of continuously feeding an odorizing agent in liquid or gaseous form into a feed zone, said feeding being carried out at a temperature above the temperature of the cryogenic fluid and above the crystallization temperature of the odorizing agent, a step b) of feeding said odorizing agent in liquid or gaseous form from step a) into a buffer zone in which the liquid or gaseous odorizing agent is brought to a temperature of about the temperature of the cryogenic fluid, and a step c) of feeding said odorizing agent cooled in step b) into the contact zone, wherein said odorizing agent comes into contact with said cryogenic fluid to be odorized.
The present invention also relates to an odorizing device for implementing said odorizing process.

11 Claims, 1 Drawing Sheet

(58) Field of Classification Search
USPC ..... 48/195
See application file for complete search history.

(56) References Cited

U.S. PATENT DOCUMENTS

| | | | | |
|---|---|---|---|---|
| 3,761,232 | A * | 9/1973 | Klass | C10L 3/006 44/349 |
| 3,907,515 | A * | 9/1975 | Mulliner | C10L 3/006 48/195 |
| 4,025,315 | A * | 5/1977 | Mazelli | C10L 3/006 44/435 |
| 6,862,890 | B2 | 3/2005 | Williams et al. | |
| 7,108,803 | B1 | 9/2006 | Mansfeld et al. | |
| 7,829,522 | B2 | 11/2010 | Charles | |
| 8,137,419 | B2 | 3/2012 | Charles | |
| 8,317,887 | B2 | 11/2012 | Charles | |

FOREIGN PATENT DOCUMENTS

| | | | |
|---|---|---|---|
| EP | 1758970 | A1 | 3/2007 |
| EP | 1934314 | A1 | 6/2008 |
| EP | 2038382 | A2 | 3/2009 |
| FR | 2201424 | A1 | 4/1974 |
| FR | 2238113 | A1 | 2/1975 |
| WO | 9719746 | A1 | 6/1997 |
| WO | 2015050509 | A1 | 4/2015 |

OTHER PUBLICATIONS

Tenkrat et al., "Natural Gas Odorization", retrieved from the internet Jul. 26, 2016, www.intechopen.com, 19 pages.
Volodarsky et al., "Synthetic Chemistry of Stable Nitroxides", CRC Press, (1993), 69 pages.

* cited by examiner

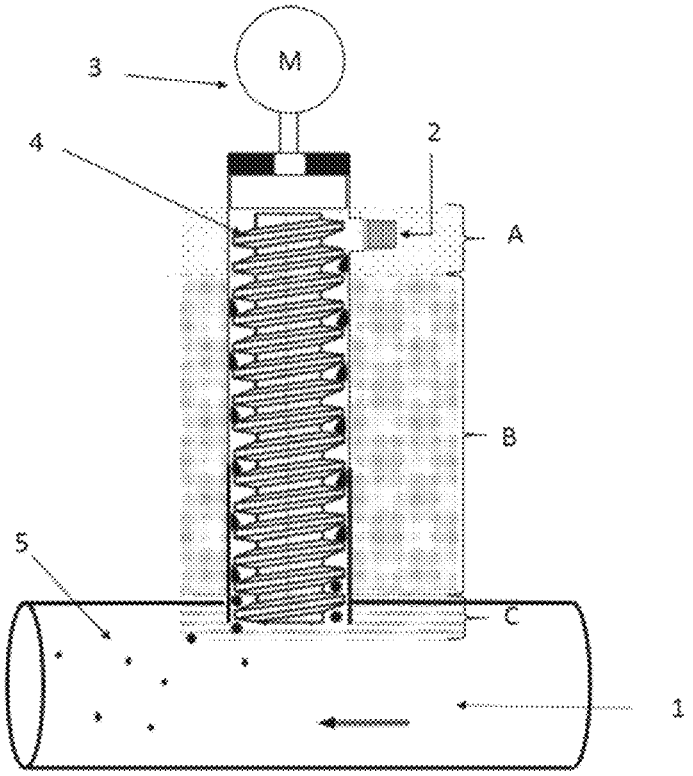
-- Figure 1 --
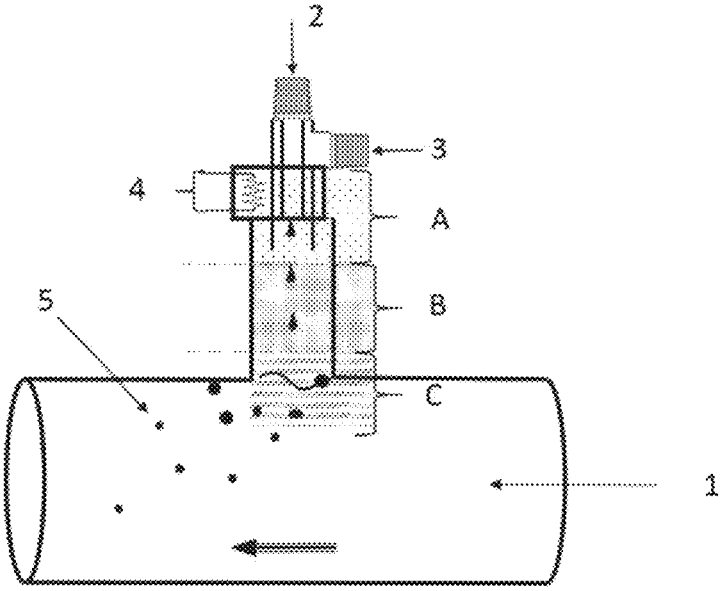
-- Figure 2 --

PROCESS FOR CRYOGENIC FLUID ODORISATION

CROSS-REFERENCE TO RELATED APPLICATIONS

This is the national phase of International Application No. PCT/FR2018/050980, filed 18 Apr. 2018, which claims priority to French Application No. 1753565, filed 25 Apr. 2017. The disclosure of each of these applications is incorporated herein by reference in its entirety for all purposes.

FIELD OF THE INVENTION

The present invention relates to a process for odorizing a cryogenic fluid, in particular to enable the olfactory detection thereof and to warn of any leakages, particularly when the cryogenic fluid may represent a danger by inhalation, a risk of explosion, and the like.

The present invention also relates to a device for odorizing the cryogenic fluid by applying the process of the invention.

DESCRIPTION OF THE BACKGROUND

Techniques for odorizing gases are now well known, in particular techniques for odorizing natural gas, as described for example in EP1758970, EP1934314 and EP2038382. In these documents, an odorizing formulation, which is liquid at ambient temperature, is added to a fuel in the form of a gas, for example natural gas.

However, none of the odorants conventionally used for natural gas are liquid at the temperatures of cryogenic fluids. At these temperatures, the conventional odorants are in the solid state, which poses problems of compatibility with the odorizing systems known today. It is therefore not possible to transpose the gas odorization technologies known up until now, in order to odorize cryogenic fluids.

For the purposes of the present invention, the term "cryogenic fluid" means any fluid that can be stored in the liquid state under cryogenic conditions, that is to say at temperatures of about −150° C. and below −150° C. Examples of cryogenic fluids are, by way of nonlimiting example, light alkanes (methane, ethane, propane), $C_2$-$C_5$ alkenes, inert gases (for example nitrogen), industrial gases (oxygen, hydrogen), and others. It should be understood that the invention focuses on the addition of an odorizing agent (odorization agent) in cryogenic fluids in the liquid state, and not on the addition of odorizing agent to fluids in the gaseous state.

Thus, introduction of an odorizing agent, optionally in the form of an odorizing formulation, known to those skilled in the art and having crystallization points well above −150° C., as indicated above, in a cryogenic fluid, would result in crystallization of said agent or of said formulation within the injection systems. The direct introduction in the form of a spray, as described, for example, in U.S. Pat. No. 6,862,890, would have the effect of instantaneously solidifying said odorizing agent or said odorizing formulation in the form of fine particles, which can lead to problems of clogging and blocking, and possibly the need to drastically increase flows and pressures to avoid these problems. It goes without saying that such problems of clogging or blocking or drastic solutions to avoid these problems are difficult to make compatible with an effective and safe industrial process.

However, effective odorization of a cryogenic fluid requires the dissolution of a generally very small and controlled amount of the odorizing ingredient in said cryogenic fluid, so that the odorant is present homogeneously in the cryogenic fluid and that, when vapors of said cryogenic fluid (for example in case of leakage, when it is at ambient temperature), an effective amount of odorant is definitely present in said vapors and that the olfactory detection threshold in the air is reached so as to allow the required alert.

Document DE102004050419 describes, for its part, a process for odorizing a cryogenic liquid fuel, the odorization operation being performed on the fluid in the gaseous state, after evaporation of said cryogenic fluid.

The odorization of liquefied natural gas has been the subject of a patent application published under No. FR2201424. This patent application in fact discloses an odorization process comprising the preparation of a solution of a diluent with an odorizing product, the cooling of this solution, then the introduction of this cooled solution into the liquefied natural gas in odorization amounts that are effective for odorizing the liquefied natural gas. The technique presented in this patent application, suffers, however, from numerous drawbacks, including that of requiring the preparation of a solution of a diluent of the odorizing ingredient, which must be cooled before use. In addition, the diluent used must comply with imperative conditions in terms of crystallization point, relative to the odorant and with respect to the natural gas to be odorized, such that the diluent mainly mentioned, not to say only mentioned, is propane. Thus another drawback linked to the abovementioned technique is the contamination of the fluid to be odorized by the appropriate diluent (propane), which can be troublesome, depending on the nature of the cryogenic fluid to be odorized and the use that is made of it later.

SUMMARY OF THE INVENTION

The object of the present invention is to propose a process that is simple to implement, most particularly at the industrial level, that is to say for the odorization of very large amounts of cryogenic fluids, without having the known drawbacks of the prior art techniques, in particular those using a diluent that can pollute said cryogenic fluid to be odorized, and thus potentially be a hindrance to the use that is made of said cryogenic fluid.

Another objective of the invention is to propose a process that is simple to implement, most particularly at the industrial level, while at the same time allowing a controlled addition without restrictions with respect to the conditions of flow rate and pressure of an odorizing agent to be introduced. Other objects and advantages will further emerge in the following description of the present invention.

Thus, and according to a first aspect, the present invention relates to a process for odorizing a cryogenic fluid, comprising at least the following steps:

a) continuously feeding an odorizing agent in liquid or gaseous form, preferably in liquid form, into a feed zone, said feeding being carried out at a temperature above the temperature of the cryogenic fluid and above the crystallization temperature of the odorizing agent, for example at ambient temperature,
b) feeding said odorizing agent in liquid or gaseous form from step a) into a buffer zone in which the liquid or gaseous odorizing agent is brought to a temperature of about the temperature of the cryogenic fluid, and
c) feeding said odorizing agent cooled in step b) into the contact zone, wherein said odorizing agent comes into contact with said cryogenic fluid to be odorized.

According to a preferred aspect of the present invention, each of the steps a), b) and c) of the process is carried out continuously. According to another preferred aspect of the present invention, the flow rate of the odorizing agent in the contact zone is proportional to the flow rate of the cryogenic fluid. According to a most particularly preferred aspect, the flow rate of ododorizing agent in the contact zone is automatically controlled by the flow rate of the cryogenic fluid.

BRIEF DESCRIPTION OF THE FIGURES

FIG. 1: an example of a device for implementing the process for odorizing a cryogenic fluid according to the present invention. This device comprises a feed zone (A), a buffer zone (B) and a contact zone (C).

FIG. 2: example of a device making it possible to implement the process for odorizing a cryogenic fluid, according to the present invention, the device also comprising a feed zone (A), a buffer zone (B) and a contact zone (C).

DETAILED DESCRIPTION OF THE INVENTION

The amount of odorizing agent coming into contact with the cryogenic fluid to be odorized is between the minimum amount necessary to odorize said cryogenic fluid and the maximum to reach saturation. Too much odorizing agent in the cryogenic fluid can lead to solid deposits that could damage, or even block, pipes, valves and other members present on the industrial site of odorization of said cryogenic fluid.

Step b) of feeding the buffer zone makes it possible to isolate the feed zone from the contact zone which is at the temperature of the cryogenic fluid. In other words, the odorizing agent (optionally in the form of an odorizing formulation) is, and remains, in the liquid state in the feed zone and is gradually brought to a temperature of about, or even at, the temperature, of the cryogenic fluid, on leaving this buffer zone.

According to a preferred embodiment, in step b), the odorizing agent is brought to a temperature of about the temperature of the cryogenic fluid. The term "temperature of about" means a temperature less than 30° C., preferably less than 20° C., more preferably less than 10° C., above the temperature of the cryogenic fluid to be odorized.

In step c), the odorizing agent cooled in step b) is brought into contact with said cryogenic fluid to be odorized. During contact, the odorizing agent is most often in solid form, advantageously in the form of droplets of solidified odorizing agent or else in the form of a solidified spray.

Thus, in step c), the odorizing agent comes into contact with the cryogenic fluid and is entrained with the flow of cryogenic fluid, in which it dissolves, thus allowing said cryogenic fluid to be odorized.

Optionally, but preferably, the odorizing agent is dispersed in/mixed with the cryogenic fluid. This dispersion or mixing can be carried out according to any method known to those skilled in the art, for example by simple contact of the odorizing agent with a flow of cryogenic fluid, or else by any mechanical means, such as a static mixer, stirrer, propeller, and the like.

Among the mechanical assistance systems that are most particularly suitable for conveying the odorizing agent toward the cryogenic fluid, mention may be made, by way of nonlimiting examples, of blades, scrapers, rakes, knives, worm screws used alone or combined or any other technique for conveying liquids or solids.

Preferably, the mixture is produced by simple contact of the odorizing agent with a flow of cryogenic fluid in a turbulent regime. The term "turbulent regime" means a flow defined by a Reynolds number greater than the critical Reynolds number, that is to say, for a flow in a tubular pipe, a Reynolds number greater than 2000, or even greater than 3000.

In general, the feed of odorizing agent is such that the concentration of odorizing agent in the cryogenic fluid is between 0.1 $mg/m^3$ (n) and 500 $mg/m^3$ (n), preferably between 0.5 $mg/m^3$ (n) and 100 $mg/m^3$ (n), more preferably between 0.5 $mg/m^3$ (n) and 50 $mg/m^3$ (n). The concentration is measured with respect to $m^3$ (n) corresponding to 1 $m^3$ of gas in the vapor state under normal temperature and pressure conditions (0° C. and 1013.25 hPa).

By virtue of the present invention, it is thus possible to have a simple and effective process for odorizing cryogenic fluid, which can operate continuously or batchwise, without the risk of clogging or blocking of pipes, tubing, valves or other devices in which said cryogenic fluid flows, said process comprising the steps defined above, wherein an odorizing agent is brought into contact with said cryogenic fluid.

The odorizing agent used in the present invention may be of any nature, depending on the desired effect, the desired detection threshold, the expected odor, and the like.

The odorizing agent is advantageously chosen from the family of hydrocarbons, for example terpenes, from the family of alcohols and phenols, from the family of aldehydes, from the family of cyclic or non-cyclic ethers, from the family of esters, for example the family of acrylates and (alkyl) acrylates, from the family of fatty acids, from the family of ketones, from the family of lactones, from the family of mercaptans, for example alkyl mercaptans, (alkyl) thioalkyl mercaptans, the family of cyclic sulfides, the family of symmetrical or non-symmetrical dialkyl sulfides, the family of symmetrical or non-symmetrical dialkyl disulfides, or also from the family of selenium derivatives, for example alkyl or dialkyl selenides or diselenides, whether they are symmetrical or non-symmetrical. Mixtures of at least two of the odorizing agents mentioned above, in any proportions, can also be envisioned.

According to a preferred embodiment, the odorizing agent is chosen from alcohols and phenols, such as, for example and in a nonlimiting manner, nerol, phenyl-3-propan-1-ol, linalol, geosmin, p-cresol, 3,5-dimethylphenol, 3-ethylphenol and 1-naphthol. According to another preferred embodiment, the odorizing agent is chosen from the family of aldehydes, such as, for example and in a nonlimiting manner, trans-2,trans-4-decadienal, trans-2,trans-4-hexadienal, trans-2,trans-4-octadienal, trans-2,trans-4-nonadienal, ethylvanillin, cis-3-hexenal, trans-4-hexenal, trans-2,cis-6-nonadienal, 4,5-epoxy-2-dodecenal and iso-valeraldehyde.

According to yet another preferred embodiment, the odorizing agent is chosen from the family of ethers, such as, in a nonlimiting manner, 1-methoxynaphthalene, 2-methoxynaphthalene, 1-ethoxynaphthalene, pyrans, for example cis-rose-oxide.

According to yet another preferred embodiment, the odorizing agent is chosen from the family of mercaptans, such as, in a nonlimiting manner, methyl mercaptan, ethyl mercaptan, tert-butyl mercaptan, sec-butyl mercaptan, iso-butyl mercaptan, n-propyl mercaptan, iso-propyl mercaptan, pentyl mercaptans, cyclohexyl mercaptan, and n-dodecyl mercaptan.

According to yet another preferred embodiment, the odorizing agent is chosen from the family of alkyl sulfides, disulfides or even polysulfides, such as, in a nonlimiting manner, methyl ethyl sulfide (MES), dimethyl sulfide (DMS) and diethyl sulfide (DES) or tetrahydrothiophene (THT).

In yet another preferred embodiment, the odorizing agent is chosen from the family of esters, such as, in a nonlimiting manner, methyl, ethyl, allyl, n-propyl, iso-propyl, n-butyl, iso-butyl, tert-butyl, pentyl, hexyl, heptyl, octyl and dodecyl acrylates, methy, ethyl, allyl, n-propyl, iso-propyl, n-butyl, iso-butyl, tert-butyl, pentyl, hexyl, heptyl, octyl and dodecyl methacrylates, propyl isovalerate, iso-pentyl isovalerate, methyl dodecanoate, ethyl dodecanoate, ethyl undecanoate, methylheptyne carboxylate and di-(methoxy-2-phenyl) carbonate.

According to yet another preferred embodiment, the odorizing agent is chosen from the family of fatty acids such as, but not limited to, butyric acid, iso-valeric acid and 2-methylpropionic acid.

According to yet another preferred embodiment, the odorizing agent is chosen from the family of nitrogenous compounds comprising, by way of nonlimiting examples, lactones (such as caprolactone), nitriles (such as 2-nonenenitrile) and pyrazine compounds (such as 2-methylpyrazine, 2,3-dimethylpyrazine, 2,6-dimethylpyrazine, 2,3,5-trimethylpyrazine, tetramethylpyrazine, 2-ethylpyrazine, 2,3-diethylpyrazine, 5,2-methylethylpyrazine, 2,3-methylethylpyrazine, 5,2,3-methyldiethylpyrazine and 3,5,2- and 3,6,2-dimethylethylpyrazine), 2,3-methylethylpyrazine and tetramethylpyrazine, and the like, as mentioned in document DE19837066.

The ketone family also represents a family of preferred odorizing agents, among which ketones mention may be made, by way of nonlimiting examples, of 3-methylnonan-2,4-dione, 1-nonen-3-one, 3-hydroxy-4,5-dimethyl-2-(5H)-furanone, 3-hydroxy-4,5-diethyl-2-(5H)-furanone, 3-hydroxy-4-methyl-5-ethyl-2-(5H)-furanone, 3-hydroxy-4-ethyl-5-methyl-2-(5H)-furanone, 3-hydroxy-4-methyl-5-butyl-2-(5H)-furanone, 3-hydroxy-4-methyl-5-iso-butyl-2-(5H)-furanone, 3-hydroxy-4-methyl-5-propyl-2-(5H)-furanone, 2,5-dimethyl-4-methoxy-3-(2H)-furanone, ionones, damascenones, trans-2-nonen-4-one, furaneol and 1-(2,2,6-trimethylcyclohexyl)-2-butenone.

Another family of preferred odorants consists of lactones, such as, for example, and without limitation, 3,6-dimethyl-3a,4,5,7a-tetrahydro-2-(3H)-benzofuranone, γ-nonalactone, γ-undecalactone, (Z)-6-dodeceno-γ-lactone, and coumarin.

According to yet another preferred embodiment, the odorizing agent is chosen from the family of selenium derivatives, among which mention may be made, by way of nonlimiting examples, of dimethyl selenide, dimethyl diselenide, diethyl selenide, diphenyl selenide, diphenyl diselenide and ethylselenol, and the like, such as those mentioned in document WO 2015/050509.

The odorant perception thresholds mentioned above are all of the order of magnitude of about ten parts per billion (ppb), or even less. They are mostly less than 1 ppb.

According to a most particularly preferred embodiment, the odorizing agent that can be used in the present invention is chosen from methyl ethyl sulfide, dimethyl sulfide, diethyl sulfide, dimethyl disulfide, diethyl disulfide, methyl mercaptan, ethyl mercaptan, tert-butyl mercaptan, sec-butyl mercaptan, iso-propyl mercaptan, n-propyl mercaptan, cyclohexyl mercaptan, tetrahydrothiophene, methyl acrylate, ethyl acrylate, methyl methacrylate, ethyl methacrylate, methylethylpyrazine, dimethyl selenide and dimethyl diselenide.

The odorizing agents that can be used in the context of the present invention can be used pure, in a mixture of two or more of them in any proportions or else diluted with other compounds compatible with the cryogenic fluid, in particular with one or more solvents that are known to those skilled in the art and liquid at ambient temperature, such as those chosen from $C_5$-$C_6$ alkanes (for example n-pentane, isopentane, cyclohexane, methyl pentane, petroleum ether and also mixtures of two or more thereof), alcohols, ethers, esters, ketones, sulfones, sulfoxides, and preferably chosen from alkanes, alcohols and ethers.

However, it is preferred to use the odorizing agents in the context of the present invention alone or in mixtures of two or more of them in any proportions, optionally, but not in a preferred manner, diluted with one or more solvents as indicated above, in proportions of solvent(s) not however exceeding 20%, even better still not exceeding 10%, by weight of solvent relative to the total weight of odorizing agent(s)+solvent(s).

In a preferred embodiment, the solvent is chosen from $C_5$-$C_6$ alkanes of which the physical properties allow for easy handling, and typically those that are liquid at ambient temperature.

In a preferred embodiment, the solvent is iso-pentane, which makes it possible in particular to lower the crystallization point of the odorizing composition and to be closer to the cryogenic fluid temperature, which is, for example, −162° C. for LNG ("Liquefied Natural Gas"), and therefore close to the melting point of isopentane (−160° C.).

In addition to the possible solvent, the odorizing agent that can be used in the context of the present invention may also comprise one or more additives chosen from heat stabilizers, dyes, antioxidants, such as, for example, those of phenolic type, stable nitroxy radicals, for example of tetramethylpiperidine oxide type (also known as TEMPO) and other derivatives, in particular described in "*Synthetic Chemistry of Stable Nitroxides*" by L. B. Volodarsky et al., CRC Press (1993), ISBN: 0-8493-4590-1.

The concentration of odorizing agent, when it is diluted in a solvent and/or when it is mixed with one or more additives (this is called "odorizing formulation") can be in large proportions, and generally between 0.1% and 100% by weight of odorizing agent relative to the total weight of the odorizing formulation. In a preferred embodiment, the odorizing agent represents 100% of the odorizing formulation, i.e. the odorizing agent is used without solvent.

In another preferred solution, the odorizing agent will represent between 10% and 50% by weight of the odorizing formulation. In another preferred embodiment, the odorizing agent is used in the absence of solvent and/or in the absence of any other additive, making it possible to minimize the contamination of the cryogenic fluid.

Without wishing to be bound by theory, the present invention consists of a process which continuously produces fine particles of a solid odorizing agent from said odorizing agent in liquid form, said fine particles of said solid odorizing agent then being continuously introduced into a cryogenic fluid in which they dissolve.

It is preferred to carry out the cryogenic fluid odorization process continuously, this embodiment being most particularly suitable for facilitating mixing and in particular for ensuring the homogeneity of the cryogenic fluid which is odorized. The odorization process according to the invention may also be carried out batchwise, it being possible for this embodiment to typically be carried out by introducing a feedstock of odorizing agent (optionally in the form of an odorizing formulation) into at least one portion of the cryogenic fluid to be odorized, for example in a stream of static cryogenic fluid, in a bypass, and the like, then diluting this at least one portion of the odorized cryogenic fluid in said cryogenic fluid to be odorized.

According to another aspect, the present invention relates to a device for introducing an odorizing agent into a cryogenic fluid, said device being suitable for implementing the process according to the present invention. In a preferred embodiment, the device comprises:

1) a feed zone, which is fed with odorizing agent in liquid or gaseous form, preferably liquid form,
2) a buffer zone in which the liquid or gaseous odorizing agent is brought to a temperature of about the temperature of the cryogenic fluid, and
3) a contact zone, wherein said odorizing agent comes into contact with said cryogenic fluid to be odorized.

The feed zone consists of any system for transferring the odorant from its storage to the buffer zone. The feed zone is fed, preferably continuously, with an odorizing agent that is in liquid or gaseous form, preferably in liquid form, said feeding preferably being carried out at ambient temperature. Feeding the odorizing agent in the solid state is not preferred, for obvious reasons of handling and metering, particularly when implementing the odorization process according to the present invention in continuous mode.

The transfer of the odorizing agent into the feed zone can be carried out by means of a pump or any other pumping technique, or else by pressure difference between the storage and the buffer zone, or alternatively by pressure differential when injecting pre-loaded doses into intermediate storage. The flow rate can also be controlled, for example by means of a flowmeter, optionally combined with a control valve.

The odorizing agent can thus be fed by any means known per se, for example by means of a pump or any other device making it possible to apply a pressure differential. According to a preferred embodiment, the feed pressure is between 0.1 MPa and 10 MPa, preferably between 0.1 MPa and 5 MPa. The pressure values given above are values corresponding to absolute pressures.

One of the advantages of the present invention is that the odorizing agent can be stored and used in a wide range of temperatures, for example possibly ranging from −100° C. to +100° C., typically from −50° C. to +60° C. According to a most particularly preferred embodiment, the storage temperature is the temperature of the odorization site. The storage pressure is most generally atmospheric pressure, it being possible for the operating pressure to be different than the storage pressure to ensure the transportation of the odorizing agent to the feed zone.

Thus, the feeding of odorizing agent can be carried out by any device for transferring fluid (in the liquid or gaseous state), advantageously in a controlled manner, and preferably in a controlled and regulated manner.

The arrival in the buffer zone b) of the odorizing agent, typically when it is liquid, can be carried out by any means known per se, and for example by means of at least one or more elements chosen from a cannula, a nozzle, an injector or any other means for drip or spray feeding, and the like, it being possible for said abovementioned elements to be used alone or in a combination of one or more of them.

This arrival in the buffer zone b) can also be carried out, typically when the odorizing agent is in gaseous form, by entrainment of said odorizing agent (vapor pressure), optionally with a carrier gas, as described for example in the international application WO1997/019746, or else such as nitrogen, helium, argon, hydrogen, natural gas, methane, or any other light alkane, or even a portion of the cryogenic fluid to be odorized, said fluid having been previously vaporized, for example with a bypass system, as described for example in U.S. Pat. No. 2,058,508.

According to a preferred embodiment, the odorizing agent can be thermostated in the feed zone a) and/or optionally upstream of said feed zone, in order to regulate/control the concentration of odorizing agent in the carrier gas.

In a preferred mode of supply, the odorizing agent is injected in the form of a spray, it being possible for said spray to be obtained by any technique known to those skilled in the art.

In another preferred embodiment, the feed zone, and also preferably the buffer zone, is(are) equipped with means for maintaining at a temperature above the crystallization temperature of the odorizing agent, so that said odorizing agent is maintained in the fluid state (liquid or gaseous state), these means being typically one or more thermal insulation systems well known to those skilled in the art, and for example a vacuum insulation, or a circulation of a gas of which the boiling point is lower than or equal to the temperature of the cryogenic fluid. By this is meant the fact that such a gas will not condense on cooling to the temperature of the cryogenic fluid, thus allowing a zone free of cryogenic fluid (buffer zone) to be maintained.

In another preferred embodiment, the thermal insulation may be carried out by reheating the feed zone with a heat-transfer fluid, which is optionally thermostated, by reheating by means of a heating resistor, by induction, conduction, or the like.

The buffer zone b) makes it possible in particular to bring the liquid or gaseous odorizing agent to a temperature of about the temperature of the cryogenic fluid. This buffer zone has the effect of isolating the supply zone from the contact zone which is at the temperature of the cryogenic fluid. In other words, the odorizing agent is, and remains, in the fluid state (liquid or gaseous) in the feed zone and is gradually brought to a temperature of about, or even at, the temperature of the cryogenic fluid, on leaving the buffer zone b).

In a preferred embodiment, the temperature of the buffer zone is maintained, at least in part, at a temperature above the melting point of the odorizing agent, in order to prevent the cooling of said odorizing agent below its crystallization point, because of the proximity of the contact zone of which the temperature, typically equal to that of the cryogenic fluid. The maintaining of this temperature can be achieved by any means known to those skilled in the art, for example by means of a gas headspace in at least one portion of the feed zone and/or of the buffer zone, by preheating of the optionally formulated odorizing agent, heating of the feed zone and/or of the buffer zone, use of thermally insulating materials, and the like, or a combination of two or more of the abovementioned techniques.

The gas headspace is generally created by feeding a gas of which the liquefaction point is below or equal to the boiling point of the cryogenic fluid. Typical examples of gases are nitrogen, argon, helium, hydrogen, methane, natural gas, and the like, and also mixtures thereof.

This gas can be introduced into at least one portion of the feed zone and/or at least one portion of the buffer zone. The rate of introduction of this gas is generally between 0.1 $l \cdot min^{-1}$ and 500 $l \cdot min^{-1}$, preferably between 0.2 $l \cdot min^{-1}$ and 10 $l \cdot min^{-1}$. In a more particular embodiment, the gas flow rate can also make it possible to apply a pressure differential allowing a controlled and regulated feed of the odorizing agent into the feed zone. In a preferred solution, the gas flow rate is controlled depending on a temperature measurement performed within the feed zone.

The heating of the feed zone and/or the preheating of the odorizing agent makes it possible to maintain the temperature of the feed zone and/or at least one portion of the buffer zone at a temperature above the melting point of the odorizing agent.

The buffer zone b) represents the space between the feed zone in which the odorizing agent is in liquid or vapor form, and the contact zone (or surface of the cryogenic fluid) in which the odorizing agent comes into contact with the cryogenic fluid.

This buffer zone has a temperature gradient between the temperature of the feed zone and the temperature of the contact zone. In a preferred embodiment, the temperature gradient (typically cooling gradient) is obtained by the cryogenic fluid under consideration.

In an embodiment of the invention, the buffer zone b) can be equipped with mechanical assistance allowing improved transportation of said odorizing agent to the cryogenic fluid, as described later in the description.

The introduction of the odorizing agent into the cryogenic fluid is carried out in the contact zone c). Said contact zone c) is preferably stirred to facilitate the dispersion of the odorizing agent to facilitate rapid dissolution in the medium. This stirring can be generated by any means known to those skilled in the art, for example mechanical stirring, convection, circulation or recirculation by means of pumps or any other device for generating a stream of greater or lesser flow rate.

In a preferred embodiment, the contact of the odorizing agent with the surface of the cryogenic fluid will be carried out in a stream of cryogenic fluid thus making it possible to promote the dispersion of the odorizing agent, in a homogeneous manner, within the cryogenic fluid which thus becomes an odorized cryogenic fluid.

As indicated above, the passage from the feed zone to the contact zone, through the buffer zone, can be carried out gravitationally and/or with mechanical assistance, making it possible to convey the odorizing agent, optionally in the form of an odorizing formulation, to the cryogenic fluid to ensure the contacting.

The process of the present invention thus has several advantages and most particularly that of not using the preparation of a premix containing the odorizing agent in a matrix as for example described in patent application FR2201424. The process of the present invention is therefore easier to implement in that it does not require the use of additional solvent or else only in small amounts, therefore no storage, and therefore little or no contaminant in the odorized cryogenic fluid.

Indeed, by virtue of the process of the invention using the device described above, the addition of the odorizing agent to the cryogenic fluid is simplified, without the need for prior preparation of an odorant concentrate, for example in a hydrocarbon such as propane, as described for example in FR2201424.

The device for odorizing a cryogenic fluid described above can be in various forms and have various appearances. Appended FIGS. 1 and 2 show two possible, but nonlimiting, embodiments.

FIG. 1 shows an example of a device for implementing the process for odorizing a cryogenic fluid according to the present invention. This device comprises a feed zone (A), a buffer zone (B) and a contact zone (C).

The odorizing agent, optionally in the form of an odorizing formulation, is introduced with a carrier gas via the pipe (2) into the upper part of the worm screw (4) which is subjected to a rotational movement, via the motor (3), so that the odorizing agent (or odorizing formulation) reaches, in the form of dispersed particles (5), the stream of cryogenic fluid (1) flowing in the direction indicated.

FIG. 2 represents another example of a device making it possible to implement the process for odorizing a cryogenic fluid, according to the present invention, the device also comprising a feed zone (A), a buffer zone (B) and a contact zone (C).

The odorizing agent (optionally in the form of an odorizing formulation) is introduced via the pipe (2), with a carrier gas via the pipe (3), into the feed zone (A) comprising a heating resistor (4) intended to maintain a temperature above the solidification temperature of the odorizing agent (or of the odorizing formulation) which passes through by gravity, via the buffer zone (B), into the contact zone (C) where it is dispersed (5) in the cryogenic fluid (1) flowing in the direction indicated.

The odorizing device presented in this invention has many advantages, among which we can be mention how easy it is to use. Indeed, because of its small size and its easy installation, the device can be easily installed in places where it is desired to carry out the odorization of a cryogenic fluid. The process of the invention consequently has a particularly advantageous application when it is implemented by means of the device according to the present invention.

Thus, such continuous or batchwise processes for odorizing cryogenic fluids can be implemented in many situations, such as, by way of nonlimiting examples, during the loading/filling of tank trucks, tanks, boats, barges, gas cylinders, and like, from tanks, boats or barges or during the same process of liquefaction of the cryogenic fluid during transfer to/or within storage, and the like.

More specifically, the odorization process according to the invention has a most particularly advantageous application for the odorization of liquefied natural gas (LNG), especially when loading tank trucks or static or mobile storage from methane tankers, possibly by means of one or more tanks.

In a most particularly preferred embodiment, the odorizing agent belongs to the family of odorants conventionally used to odorize natural gas and is typically chosen from mercaptans and sulfides. This embodiment is most particularly suitable for the odorization of LNG, which then has a characteristic odor of gas, thereby enabling the detection and identification of leaks during transportation, storage and use of said LNG, in order to warn of any danger associated with the accumulation of natural gas in the air.

By virtue of the process of the present invention, in particular when it is implemented for the odorization of LNG, it is now possible to dispense with gas odorization stations during the LNG regasification step. Indeed, the odorization process of the present invention can be carried out at a single centralized point.

This centralization thus makes it possible to limit the number of places involved in the storage and handling of odorizing agents and odorizing formulations and thus the risks of olfactory pollution, the costs associated with the maintenance of the injection stations, and the like.

The invention claimed is:

1. A process for odorizing a cryogenic fluid in a liquid state, comprising at least the following steps:

a) continuously feeding an odorizing agent in liquid or gaseous form into a feed zone, said feeding being carried out at a temperature above the temperature of the cryogenic fluid and above the crystallization temperature of the odorizing agent, b) feeding said odorizing agent in liquid or gaseous form from step a) into a buffer zone in which the odorizing agent is brought to a temperature of about the temperature of the cryogenic fluid, and c) feeding said odorizing agent cooled in step b) into the contact zone at a temperature lower than the crystallization temperature of said odorizing agent causing said odorizing agent to solidify, wherein said odorizing agent in a solid form then comes into contact with said cryogenic fluid to be odorized.

2. The process as claimed in claim 1, wherein the flow rate of odorizing agent in the contact zone is proportional to the flow rate of the cryogenic fluid.

3. The process as claimed in claim 1, wherein the odorizing agent is brought, in step b), to a temperature less than 30° C. above the temperature of the cryogenic fluid to be odorized.

4. The process as claimed in claim 1, wherein the concentration of odorizing agent in the cryogenic fluid is between 0.1 $mg/m^3$ (n) and 500 $mg/m^3$ (n).

5. The process as claimed in claim 1, wherein the odorizing agent is chosen from terpenes, alcohols, phenols, aldehydes, ethers, esters, fatty acids, ketones, lactones and nitriles, pyrazine compounds, mercaptans, cyclic sulfides, dialkyl sulfides, dialkyl disulfides, or else from selenium derivatives, alone or in mixtures of two or more, in any proportions.

6. The process as claimed in claim 1, wherein the odorizing agent is chosen from methyl ethyl sulfide, dimethyl sulfide, diethyl sulfide, dimethyl disulfide, diethyl disulfide, methyl mercaptan, ethyl mercaptan, tert-butyl mercaptan, sec-butyl mercaptan, iso-propyl mercaptan, n-propyl mercaptan, cyclohexyl mercaptan, tetrahydrothiophene, methyl acrylate, ethyl acrylate, methyl methacrylate, ethyl methacrylate, methylethylpyrazine, dimethyl selenide and dimethyl diselenide.

7. The process as claimed in claim 1, wherein the odorizing agent is used pure, mixed or diluted with other compounds compatible with the cryogenic fluid.

8. The process as claimed in claim 1, wherein the odorizing agent also comprises one or more additives chosen from heat stabilizers, dyes and antioxidants.

9. The process as claimed in claim 1, wherein the cryogenic fluid is Liquefied Natural Gas.

10. The process as claimed in claim 1, wherein the odorizing agent is injected in the form of a spray in step a).

11. The process as claimed in claim 1, wherein the arrival in the buffer zone b) of the odorizing agent is carried out by means of at least one or more elements chosen from a cannula, a nozzle, an injector or any other means for drip or spray feeding; it being possible for said abovementioned elements to be used alone or in a combination of one or more of them.

* * * * *